United States Patent [19]

Aldridge

[11] 4,003,503

[45] Jan. 18, 1977

[54] DISPENSING DEVICE FOR HIGHLY VISCOUS LIQUIDS SUPPORTED IN INCLINED POSITION

[75] Inventor: George E. Aldridge, Lakehills, Tex.

[73] Assignee: ACCC, Inc., San Antonio, Tex.

[22] Filed: Dec. 11, 1974

[21] Appl. No.: 531,468

[52] U.S. Cl. ..... 222/173; 248/151

[51] Int. Cl.[2] ..... B65D 41/04

[58] Field of Search ..... 211/74; 222/100, 173, 222/191, 463, 566–568; 248/143, 151, 152, 153, 154

[56] References Cited

UNITED STATES PATENTS

| | | | |
|---|---|---|---|
| 128,699 | 7/1872 | Bostwick | 222/173 |
| 261,357 | 7/1882 | Kaye | 222/566 X |
| 416,345 | 12/1889 | Richards | 222/173 |
| 1,584,403 | 5/1926 | Shields | 222/463 X |
| 1,829,353 | 10/1931 | Hogan | 248/143 |
| 3,814,293 | 6/1974 | Daves | 222/173 |

*Primary Examiner*—Robert B. Reeves
*Assistant Examiner*—David A. Scherbel
*Attorney, Agent, or Firm*—John C. Stahl

[57] ABSTRACT

A dispensing device for highly viscous liquids comprising a container adapted to be supported in angularly declining condition, a cap including a substantially forwardly and upwardly extending nozzle adapted to be detachably secured to the container whereby in declining condition a selected liquid in the container extends at least partially into the nozzle and is readily dispensed.

2 Claims, 6 Drawing Figures

DISPENSING DEVICE FOR HIGHLY VISCOUS LIQUIDS SUPPORTED IN INCLINED POSITION

BACKGROUND OF THE INVENTION

This invention relates to a dispensing device for use primarily with relatively highly viscous liquids and more particularly to means to more rapidly dispense such liquids. At the present time many relatively highly viscous liquid products such as creams and lotions, soaps and detergents, and food products, are generally packaged in containers of varying shapes and sizes; after inverting said container, the user must wait until such slowly flowing liquid passes downwardly into the neck and nozzle before said liquid may be dispensed.

SUMMARY OF THE INVENTION

The principal object of this invention is the provision of a dispensing device for use with relatively highly viscous and slowly flowing liquids whereby said liquids may be dispensed more rapidly.

Another object is to provide such a device whereby a relatively highly viscous liquid carried in a container may be rapidly dispensed in a desired quantity and in a sanitary manner.

Still another object is to provide such a dispensing device which is simple in design, efficient in operation, and relatively trouble free over extended periods of time.

Other objects and features of the invention will become apparent to those skilled in the art from a consideration of the following specification when read in the light of the annexed drawings.

DETAILED DESCRIPTION OF THE INVENTION

Figure 1:
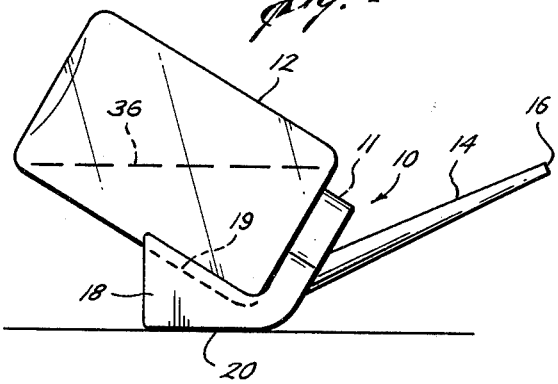
FIG. 1 is a side elevational view of the preferred embodiment of the invention adapted to accommodate a container in inclined condition.
Figure 2:
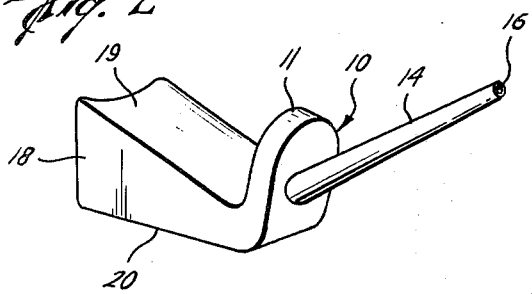
FIG. 2 is a perspective view of the preferred embodiment of the invention.
Figure 3:
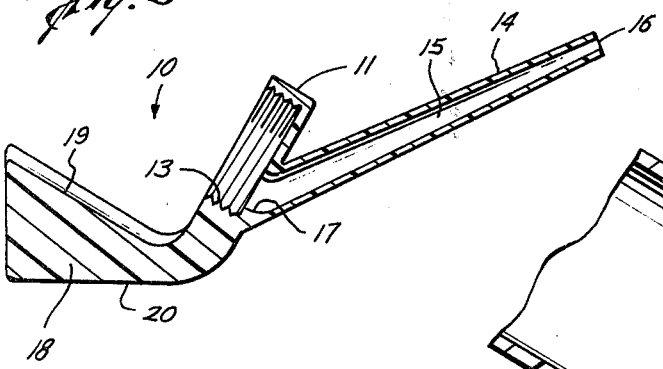
FIG. 3 is an enlarged, vertical sectional view taken along the longitudinal, medial plane of the embodiment of FIG. 2.

Referring now to the drawings, wherein like reference characters designate like or corresponding parts throughout the several views, there is shown in FIGS. 1–3 of the drawings a preferred embodiment of dispensing device 10 of the subject invention including cap 11 which is used in combination with a conventional, essentially cylindrical container 12 of desired size, configuration and composition. In many applications a container of flexible plastic composition is desirable and the contents therein may be extruded in a desired amount by finger pressure exerted upon the sides of said container.

As best seen in FIG. 3 of the drawings, cap 11 is adapted to be detachably secured to container 12. It is understood that although female threads 13 are shown in such cap which are adapted to mate with matching threads on the neck of said container, the invention is not to be restricted solely to such connecting means but also includes any type of coacting means on such members whereby a liquid-tight seal is effected. Still further, a cap or lid may be molded or fixedly secured to a container (not shown) which includes a bore in the bottom or any other desired portion thereof, or in said cap, with mating closure means whereby said container may at least partially be filled with a selected liquid and then sealed.

An upwardly and longitudinally extending nozzle 14 includes bore 15 which terminates outwardly in opening 16; inwardly, bore 15 communicates with bore 17 in proximity to the most lateral edge of said cap. In a modification of such embodiment, the outer surface of nozzle 14 may be threaded and mating threads provided in proximity to the most lateral, inner edge of said cap.

Cap 11 further includes a base 18 of any desired shape integral therewith and formed vertically below bore 17 heretofore mentioned; desirably the foremost surface of said base is in the plane of the corresponding surface of said cap. As best seen in FIG. 2, the upper surface of said base includes an arcuate, longitudinally extending recess 19 adapted to conform to the outer surface of the container and support the same in inclined condition with said cap positioned downwardly. Surface 20 of said base, of any desired plan and of sufficient area to support said container in inclined condition, extends angularly outward at a selected angle whereby the longitudinal axis of said container ranges from 15°–60° relative to the horizontal plane. As will hereinafter be more fully described, in inclined condition nozzle 14 extends forwardly and upwardly at a selected angle. At such time, any liquid within said container flows downwardly into the neck of said container, extends at least partially into nozzle 14, and is readily dispensed.

Figure 4:
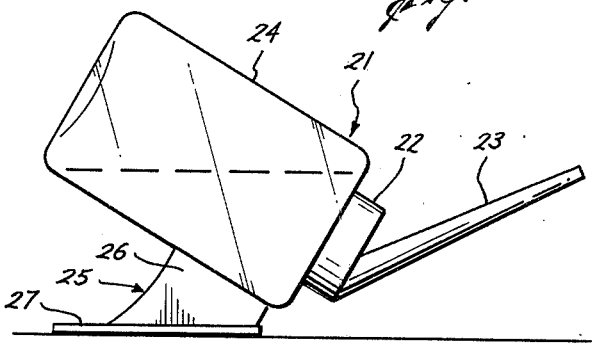
FIG. 4 is a side elevational view of another embodiment of the invention, in inclined condition.
Figure 5:
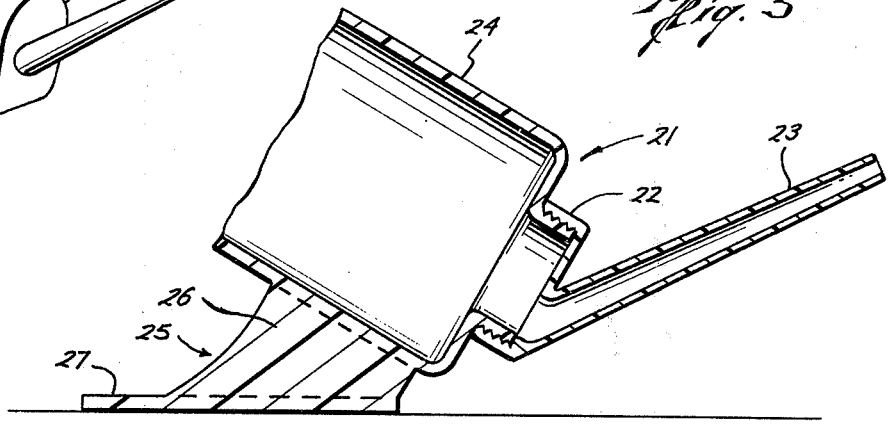
FIG. 5 is a fragmentary, enlarged, vertical sectional view taken along the longitudinal, medial plane of the embodiment of FIG. 4.

There is shown in FIGS. 4–5 of the drawings another embodiment of the invention wherein dispenser 21 includes cap 22 and nozzle 23 constructed in accordance with the principles of the invention. Cap 22 is adapted to be secured in a conventional manner to container 24 of desired size, configuration and composition. For purposes of illustration only and not in limitation, base 25, integrally formed on the outside of container 24 in a selected position in proximity to the upper rim, includes a longitudinally and outwardly extending plate 26 with a flat base plate 27 of desired plan formed or otherwise secured perpendicularly thereto; said base plate extends outwardly at a selected angle and is of sufficient area to support said container in inclined condition at an angle ranging from 15°–60° relative to the horizontal plane. Prior to use, dispenser 21 is placed in inclined condition and cap 22 rotated in such a direction that nozzle 23 extends vertically upward.

Figure 6:
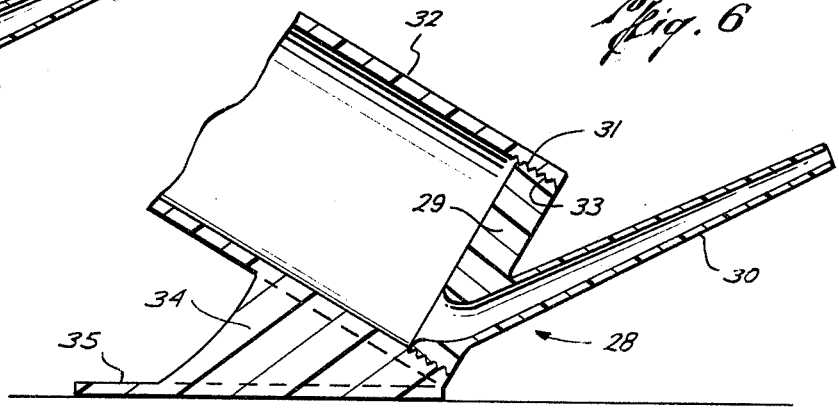
FIG. 6 is a fragmentary, enlarged, vertical sectional view taken along the longitudinal, medial plane of still another embodiment of the invention.

In dispenser 28 of FIG. 6 of the drawings, a generally flat cap 29 includes nozzle 30 in accordance with the principles of the invention and threads 31 circumferentially about said cap. Container 32 of desired size, configuration and composition includes threads 33 in the upper, inner portion thereof which are adapted to mate with threads 31 on said cap. Base 34, integrally formed on the outside of said container in a selected position in proximity to the upper rim, includes flat surface 35 of desired plan which extends outwardly at a selected angle whereby the longitudinal axis of said container is maintained in inclined condition at an angle ranging from 15°–60° relative to the horizontal plane. It is understood that prior to use dispenser 28 is placed in inclined condition and cap 29 rotated in such a direction that nozzle 30 extends vertically upward.

In each of the embodiments of the invention heretofore described in detail bases 18, 25 and 34 of desired shape do not extend substantially outwardly or rearwardly of the respective containers so as to interfere with grasping or holding the same. Furthermore, nozzles 14, 23 and 30 extend angularly upward at a selected angle ranging from 15°–60° relative to the horizontal plane and terminate in at least the horizontal plane corresponding to a predetermined, selected liquid level 36 (see FIG. 1) in such container when said container is in inclined condition, thereby preventing leakage of such liquid.

A container, constructed in accordance with the principles of the invention and carrying a relatively highly viscous liquid such as cream, lotion, soap, detergent and food products, is supported in inclined condition preparatory to use. At such time any liquid in said container flows into the neck thereof and extends at least partially into the lower portion of the nozzle. Upon inverting said container, the liquid is dispensed either by gravity flow or by a slight finger pressure exerted upon the sides of the container when a "squeeze bottle" or one of flexible plastic composition is utilized.

It should be understood, of course, that the foregoing disclosure relates to only preferred embodiments of the invention and that it is intended to cover all changes and modifications of the apparatus chosen for the purposes of the disclosure which do not constitute departures from the spirit and scope of the invention.

What is claimed is:

1. In combination with a container adapted to carry a relatively highly viscous liquid, a cap adapted to be secured to said container in a liquid-tight seal, a nozzle on said cap, means on said cap adapted to maintain said container in normally downwardly inclined condition with said cap positioned downwardly, said nozzle extending angularly upward from said cap with respect to the longitudinal axis of said container in downwardly inclined condition, said nozzle terminating upwardly in proximity to the horizontal plane of a predetermined liquid level in said container in normally downwardly inclined condition.

2. In combination with a flexible container adapted to carry a relatively highly viscous liquid, a cap adapted to be detachably secured to said container in a liquid-tight seal, a nozzle on said cap, support means on said cap adapted to maintain said container in normally downwardly inclined condition with said cap positioned downwardly, said nozzle extending angularly upward and terminating in at least the horizontal plane of a predetermined liquid level in said container in normally downwardly inclined condition.

* * * * *